US007664442B2

(12) United States Patent
Takashima et al.

(10) Patent No.: US 7,664,442 B2
(45) Date of Patent: Feb. 16, 2010

(54) DEVELOPING APPARATUS

(75) Inventors: Koichiro Takashima, Numazu (JP); Yasuyuki Ishii, Mishima (JP); Yuichiro Hirata, Susono (JP); Tomonori Matsunaga, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 324 days.

(21) Appl. No.: 11/751,211

(22) Filed: May 21, 2007

(65) Prior Publication Data

US 2007/0280745 A1 Dec. 6, 2007

(30) Foreign Application Priority Data

May 30, 2006 (JP) ..... 2006-150734

(51) Int. Cl.
*G03G 15/08* (2006.01)

(52) U.S. Cl. ..... 399/281; 399/283

(58) Field of Classification Search ..... 399/272, 399/273, 281, 283
See application file for complete search history.

(56) References Cited

U.S. PATENT DOCUMENTS 4,786,936 A * 11/1988 Ikegawa et al. ..... 399/272
6,134,397 A * 10/2000 Shimazaki et al. ..... 399/281
6,229,979 B1 5/2001 Ishii et al.
6,308,038 B1 10/2001 Kakeshita et al.
6,314,257 B1 11/2001 Ishii et al.
6,522,842 B1 2/2003 Uehara et al.
6,542,710 B2 4/2003 Kakeshita et al.
6,574,444 B2 6/2003 Uehara et al.
6,594,462 B2 7/2003 Ishii et al.
6,643,484 B2 11/2003 Kojima et al.
6,647,230 B2 11/2003 Kobayashi et al.
6,952,551 B2 10/2005 Koyanagi et al.
7,013,103 B2 * 3/2006 Bae ..... 399/283
7,286,791 B2 10/2007 Ishii et al.
2006/0029436 A1 * 2/2006 Toyoda et al. ..... 399/279

FOREIGN PATENT DOCUMENTS

JP 63-106768 5/1988
JP 10-026882 1/1998

* cited by examiner

*Primary Examiner*—Sandra L Brase
(74) *Attorney, Agent, or Firm*—Fitzpatrick, Cella, Harper & Scinto

(57) ABSTRACT

A developing apparatus including: a developer carrying member carrying a developer with which an electrostatic image on an image bearing member is developed; a developer supplying/removing member having a conductive member and an insulating member on the surface thereof, and provided apart from the developer carrying member to supply and remove the developer to and from the developer carrying member, and moving directions of the developer carrying member and the developer supplying/removing member being opposed in a developer supplying position; and an electric field producing device producing between the developer carrying member and the developer supplying/removing member an oscillating electric field, in which direct potentials of the conductive member and the developer carrying member are the same, or the direct potential of the conductive member, with respect to the direct potential of the developer carrying member, is on the opposite side to a normal charging polarity of the developer.

11 Claims, 6 Drawing Sheets

PRIOR ART

DEVELOPING APPARATUS

BACKGROUND OF THE INVENTION

1. Field of the Invention

The present invention relates to developing apparatuses for developing an electrostatic image formed on an image bearing member with a developer to be a visible image, which is a toner image. A developing apparatus can be used in e.g., electrophotographic image forming apparatuses, for example, copying machines, printers, and facsimile machines.

2. Description of the Related Art

Some conventional developing apparatuses include a developer supplying member supplying a developer to a developer carrying member conveying a developer for causing an electrostatic latent image formed on an image bearing member to be visible.

Furthermore, although after an electrostatic latent image is made visible, some developer remains on the developer carrying member as a history thereof, some conventional developing apparatuses include a developer removing member removing this remaining developer.

When the above-mentioned developer supplying member or developer removing member is contacted with a developer carrying member, multiple repetitions of an image forming operation leads to a larger load on a developer, thereby resulting in a further deterioration of a developer to cause the occurrence of a faulty image.

Then, according to another conventional technique, to decrease the load on a developer, known is the technique that a developer supplying member and a developer removing member are located out of contact with a developer carrying member (Japanese Patent Application Laid-Open No. S63-106768)

In FIG. 6, one example of a conventional developing apparatus of such a construction is illustrated. FIG. 6 illustrates a cross section of a drum-shaped electrophotographic photosensitive member (hereinafter referred to as "photosensitive drum") 110 as an image bearing member and a developing apparatus 111.

In this example, there is provided in the developing apparatus 111 a developing roller 113 as a developer carrying member conveying a magnetic mono-component toner 112 for visualizing an electrostatic latent image on the photosensitive drum 110. To remove the remaining toner not having contributed to visualization on the developing roller 113, a rotary electrode 114 is disposed out of contact with the developing roller 113, and an alternating current voltage superimposed with a direct current voltage is applied to this electrode 114. Furthermore, to remove the toner 112 on the surface of the electrode 114, a scraping member 115 is contacted with the electrode 114.

Furthermore, a supplying member 116 for supplying the toner 112 to the developing roller 113 is disposed in the proximity of the developing roller 113. By the effect provided by agitation of the supplying member 116 and a magnetic force from a magnetic rubber layer 113A forming the developing roller 113, the toner 112 is supplied.

In the above-mentioned conventional example, however, since the developer is supplied and removed using two parts of the supplying member 116 and the developer removing member (electrode) 114, the developing apparatus becomes larger.

Moreover, on the other hand, since a magnetic force cannot be utilized in a developing apparatus using a nonmagnetic developer, the supply of a developer to the developer carrying member is insufficient.

In addition, when a developer cannot be removed satisfactorily from the developing roller, the history of an antecedent image sometimes remains. Such a history is referred to as a development ghost.

SUMMARY OF THE INVENTION

An object of the present invention is to provide a developing apparatus reducing a load onto a developer in a developing apparatus.

Another object of the present invention is to provide a developing apparatus capable of stably supplying a developer to a developer carrying member.

Another object of the present invention is to provide a developing apparatus capable of satisfactorily removing a developer from the developer carrying member.

Another object of the present invention is to provide a developing apparatus capable of supplying a developer to the developer carrying member and removing a developer from the developer carrying member with a common member.

Another object of the present invention is to provide a developing apparatus capable of being downsized.

Further objects and features of the present invention will become apparent from the following description of exemplary embodiments with reference to the accompanying drawings.

DETAILED DESCRIPTION OF THE PREFERRED EMBODIMENTS

Figure 1:
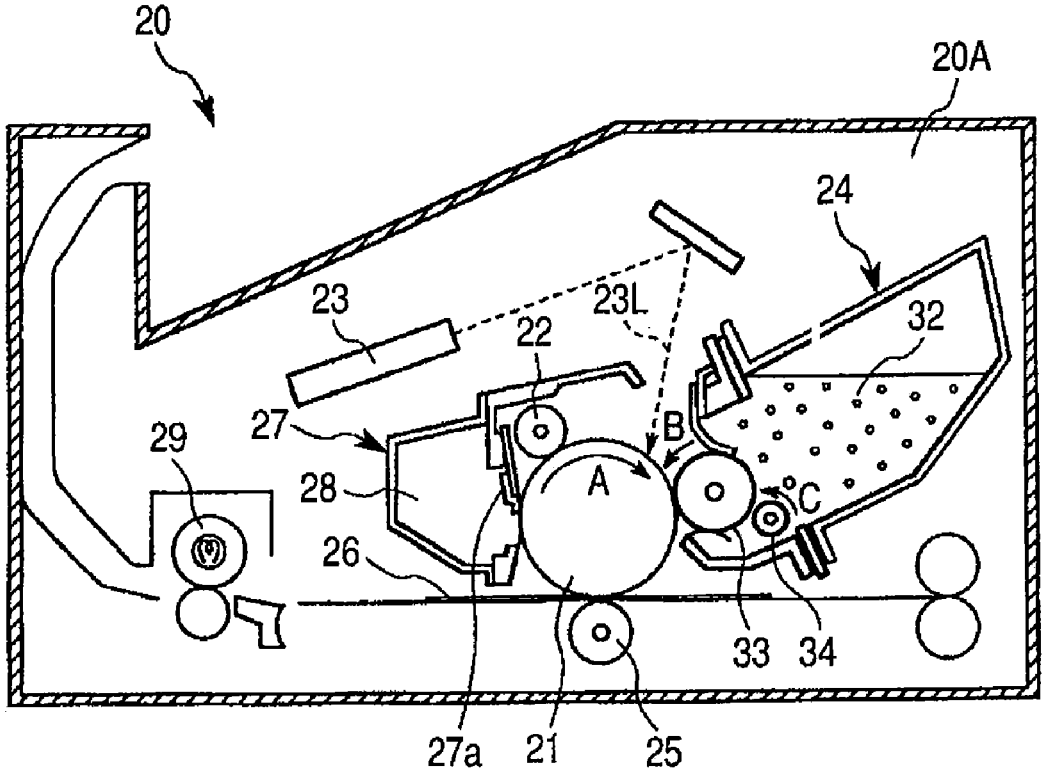
FIG. 1 is a schematic view illustrating an embodiment of an image forming apparatus according to the present invention.

Hereinafter, a developing apparatus according to the present invention will be described in further detail referring to the drawings. However, the dimensions, material and shape of components, a relative layout thereof and the like described in these embodiments have to be changed as appropriate depending on the construction of an apparatus to which the present invention is applied, or various conditions. The scope of the present invention intends not to be limited to the following embodiments.

Embodiment 1

Figure 2:
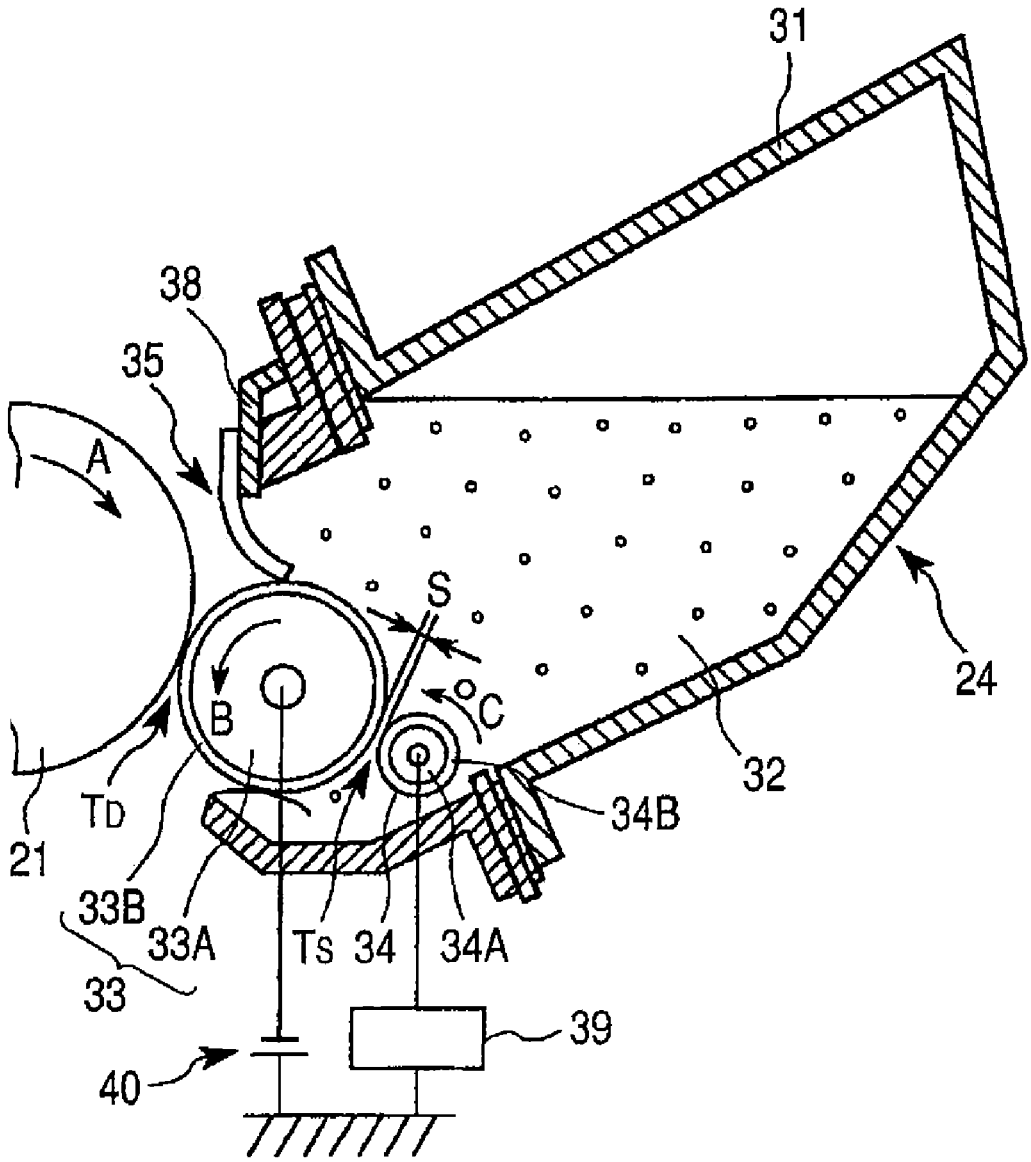
FIG. 2 is a schematic view illustrating an embodiment of a developing apparatus according to the present invention.

FIG. 1 is a schematically, sectional view of an image forming apparatus to which a developing apparatus according to the present invention is applied. FIG. 2 is a schematically, sectional view of the developing apparatus.

First, an image forming operation of the image forming apparatus according to this embodiment is described.

In this embodiment, an image forming apparatus 20 is provided with a drum-shaped electrophotographic photosensitive member as an image bearing member, which is a photosensitive drum 21. This photosensitive drum 21 is supported rotatably in the direction indicated by an arrow A. There are located at the peripheral portion of the photosensitive drum 21 a charger 22, an exposure device 23, and a developing apparatus 24.

First, the photosensitive drum 21 is uniformly charged by the charger 22, thereafter, in this embodiment, exposed with a laser beam 23L emitted by a laser optical device, being the exposure device 23, and formed with an electrostatic latent image on the surface of the photosensitive drum 21.

This electrostatic latent image is developed with the developing apparatus 24 disposed opposite to the photosensitive drum 21 to be visualized as a toner image. Incidentally, in this embodiment, the developing apparatus 24 is removable as a cartridge with respect to an image forming apparatus main body 20A.

A toner image having been visualized on the photosensitive drum 21 is transferred to a transfer material 26 as a recording medium by a transfer roller 25 as a transfer device.

A residual transfer toner remaining on the photosensitive drum 21 not having been transferred is scraped by a cleaning blade 27*a* as a cleaning member provided at a cleaning device 27, and contained in a waste toner container 28. The photosensitive drum 21 having been cleaned repeats the above-mentioned operation, and forms an image.

On the other hand, the transfer material 26 to which a toner image has been transferred is discharged to the outside of the apparatus after the toner image is permanently fixed by a fixing device 29.

Now, with reference to FIG. 2, the developing apparatus 24 is further described.

In this embodiment, the developing apparatus 24 is provided with a developing container 31 which contains a negative chargeable nonmagnetic mono-component toner 32 as a developer. The developing apparatus 24 is provided with a developing roller 33 as a developer carrying member positioned in an opening extended in a longitudinal direction (direction orthogonal to the drawing sheet of FIG. 2) in the developing container 31, the developing roller 33 being disposed opposite to the photosensitive drum 21. The developing roller 33 develops an electrostatic latent image to be visible on the photosensitive drum 21 with a developer. In this embodiment, the developing roller 33 is structured such that an elastic layer 33B is formed on a cored bar 33A. A detailed construction of the developing roller 33 will be descried below.

The photosensitive drum 21 is a rigid body in which an aluminum cylinder as a base is coated with a photoconductive layer of a predetermined thickness. The photosensitive drum 21 is uniformly charged to be at a charge potential Vd=−500 V by the charger 22, and a portion exposed with a laser beam 23L based on an image signal comes to be at V1=−100 V. To the cored bar 33A of the developing roller 33, a direct current voltage Vdc=−300 V is applied as a developing bias from a power supply 40, and a V1 portion of an electrostatic latent image is reversely developed with a negative chargeable toner.

The developing roller 33 having elasticity is provided in the above-mentioned opening so that a substantially right semicircle portion of the developing roller 33 is projected into the developing container 31, and a substantially left semicircle of the developing roller 33 is exposed from the developing container 31 as illustrated in FIG. 2. The surface of the developing roller 33 exposed from the developing container 31 is provided so as to be pressed and contacted with respect to the photosensitive drum 21 positioned on the left of the developing apparatus 24 to have a predetermined inroad amount. In this embodiment, the developing roller 33 is contacted with the photosensitive drum 21 to have an inroad amount of 50 μm. Incidentally, the inroad amount is a distance between a position of the surface of the developing roller 33 supposing that the photosensitive drum 21 is removed, and a position of the surface of the developing roller 33 when the photosensitive drum 21 is provided.

The developing roller 33, in FIG. 2, is driven to rotate in the direction indicated by an arrow B. The surface of the developing roller 33 has suitable concavities and convexities in order to enhance the probability of rubbing with a toner 32, as well as to facilitate the conveyance of the toner 32.

In this embodiment, the developing roller 33 is constructed as a two-layer structure of an elastic layer 33B in which on the cored bar 33A the surface of a urethane rubber as a base layer is coated with an acrylic urethane-based rubber. Furthermore, a surface roughness is 0.6 to 1.3 μm in Ra, and a resistance is $10^4$ to $10^7\Omega$.

Here, a measurement method of resistance is described.

The developing roller 33 is brought in contact with an aluminum sleeve of a diameter equal to that of the photosensitive drum 21 under a contact load of 500 gf. This aluminum sleeve is further rotated at a circumferential speed equal to that of the photosensitive drum 21.

In this embodiment, the photosensitive drum 21 rotates at a circumferential speed of 90 mm/sec, and is 30 mm in diameter; and the developing roller 33 rotates at a circumferential speed of 120 mm/sec higher than the photosensitive drum 21, and is 20 mm in diameter.

Next, a direct current voltage of −300 V equal to a developing bias in this embodiment is applied to the developing roller 33. On that occasion, a resistor of 10 kΩ is provided on the side of ground, and a voltage across the resistor is measured, thereby calculating an electric current passing through the developing roller 33, and the resistance of the developing roller 33.

In this embodiment, for a negative chargeable nonmagnetic toner 32 as a mono-component developer a substantially spherical toner is employed to achieve particle size reduction in order to obtain a high quality image, as well as to improve the transfer efficiency. Specifically, used is a toner, having a shape factor, having SF-1 of 100 to 180 and SF-2 of 100 to 140.

These SF-1 and SF-2 shape factors are defined to be values obtained by the use of FE-SEM (S-800) manufactured by Hitachi, Ltd., sampling 100 toner images at random, guiding these image information into an image analysis equipment (Luzex 3) manufactured by Nireco Corporation via an interface to make an analysis, and making a calculation with the following expressions.

$$SF\text{-}1=\{(MXLNG)^2/AREA\}\times(\pi/4)\times 100$$

$$SF\text{-}2=\{(PERI)^2/AREA\}\times(1/4\pi)\times 100$$

(where: MXLNG: absolute maximum length, AREA: toner projected area, and PERI: perimeter)

The shape factor SF-1 of a toner stands for the degree of sphericity; and as it is increased from 100, it gradually comes to be irregularly shaped from a spherical shape. The shape factor SF-2 stands for the degree of concavity and convexity; and as it is increased from 100, the concavities and convexities on the toner surface become marked.

A manufacturing method of a toner can employ any method insofar as the toner is within the range of the above-mentioned shape factors. For example, conventionally, the surface of a pulverized toner can be processed to be plastically spherical by thermal and mechanical stresses. Furthermore, employed can be the method of directly manufacturing a toner by a suspension polymerization method, or a dispersion polymerization method of directly producing a toner with the use of an aqueous organic solvent in which a monomer is soluble, and an obtained polymer is insoluble. Moreover, also employed can be an emulsion polymerization method typified by a soapfree polymerization method of directly making a polymerization to produce a toner under the presence of a water-soluble polarity polymerization initiator.

In this embodiment, employed was a suspension polymerization method under an ambient pressure, or under applied pressure. In addition, using styrene and n-butyl acrylate as a monomer a salicylic acid metal compound as a charge control agent, and a saturated polyester as a polar resin, and further by adding a colorant, a negative chargeable toner of a weight average particle diameter of 5 to 7 μm was manufactured.

To measure a weight average particle diameter of a toner, COULTER COUNTER TAII type or COULTER Multisizer (manufactured by COULTER Corporation) was used. An electrolyte was prepared to be an aqueous solution of 1% NaCl using a primary sodium chloride.

In 100 to 150 ml of this electrolyte aqueous solution, a surface-active agent as a dispersant, preferably 0.1 to 5 ml of alkyl benzene sulfonate is added, and further 2 to 20 mg of a measurement sample is added. The electrolyte in which the sample is added and suspended is dispersed and processed for about 1 to 3 minutes in an ultrasonic distributor. With the above-mentioned measuring equipment, using an aperture of 100 μm, the volume and the number of toner of not less than a weight average particle diameter of 2 μm is measured, and a volume distribution and a number distribution are calculated to obtain a weight average particle diameter D4 based on a weight from a volume distribution.

Thereafter, 1.5 wt % of hydrophobic silica was extraneously added to improve fluidity. The amount of an extraneous additive is not limited to this amount as a matter of course. Covering a toner surface with a film of an extraneous additive achieved improvement in negative chargeable properties, and provision of a minute gap between toners achieved improvement in fluidity.

In this embodiment, the developing apparatus 24 is positioned above the developing roller 33, and a developing blade 35 as a developer regulating member having elasticity is disposed. The developing blade 35 regulates the thickness of a layer of a developer carried on the developing roller 33. The developing blade 35 is supported at a support metal plate 38 fixed to a developing container. A contact direction of the developing blade 35 is a counter direction in which a free end of the blade 35 is positioned upstream of a contact portion of the developing blade 35 with the developing roller 33 in a rotation direction indicated by arrow B of the developing roller 33.

A support method of the developing blade 35 with respect to the support metal plate 38 can employ any method of fastening with e.g., screws, or welding. Furthermore, in this embodiment, the developing blade 35 and the support metal plate 38 are at the same potential as the developing roller 33. Therefore, when an electrostatic latent image on the photosensitive drum 21 is developed, the same voltage as a developing bias is to be applied.

The material used for the developing blade 35 is SUS, but, it may be metal, such as phosphor bronze, a rubber material, such as silicone or urethane, or resin, such as PET insofar as it possesses elasticity. In addition, a bias to be applied to the developing blade 35 needs not to be at the same potential as a developing bias, but may be selected to be a suitable bias for regulating a toner 32 on the developing roller 33.

Downward to the right of the developing roller 33 in FIG. 2, an insulator coated electrode roller 34 as a developer supplying and removing member of supplying a developer to the developing roller 33 as well as removing a developer from the developing roller 33 is disposed. The construction of an insulator coated electrode roller 34 will be described below.

The insulator coated electrode roller 34 is located out of contact with the developing roller 33. A position (region) where the insulator coated electrode roller 34 and developing roller 33 are located opposite to each other forms the below-described developer supplying and removing position (region) $T_S$. That is, the electrode roller 34 is provided being spaced apart from the developing roller 33 in the developer supplying and removing region $T_S$. The size of a minimum gap S between the developing roller 33 and the insulator coated electrode roller 34 in a developer supplying and removing region $T_S$, as described below, is determined by a maximum electric field intensity formed by a required voltage to be applied between the developing roller 33 and the insulator coated electrode roller 34. A gap S is preferably 10 to 400 μm, and in this embodiment (examples 1, 3, 4, 9, and 10), was 150 μm.

To describe further, an insulator coated electrode roller 34 is rotatably supported and driven to rotate in the same direction (in a direction indicated by the arrow C, that is, in a counter-clockwise direction) as a rotation direction (in a direction indicated by the arrow B, that is, in a counter-clockwise direction) of the developing roller 33. That is, in the developer supplying and removing position $T_S$, a moving direction (toner conveying direction) of the developing roller 33 is in an opposite direction to a moving direction (toner conveying direction) of the insulator coated electrode roller 34. In this embodiment, the insulator coated electrode roller 34 is driven to rotate at a circumferential speed of 80 mm/sec in a rotation direction C.

To the insulator coated electrode roller 34, in this embodiment (examples 1, 11, and 12), from a power supply 39 provided at a main body of an image forming apparatus, applied is a bias obtained by superimposing a sine wave alternating current voltage of 4 kVpp and 400 Hz of frequency on a direct current voltage of +2.0 kV. Whereby, in a developer supplying and removing region $T_S$, an oscillating electric field is formed between the developing roller 33 and the insulator coated electrode roller 34.

The insulator coated electrode roller 34 is formed by putting a layer of an insulating material 34B as an insulating member on top of the surface of a conductive material 34A as a conductive member. In this embodiment, the insulator coated electrode roller 34 is made by putting a layer of a polycarbonate resin 34B of a thickness of 100 μm on top of the surface of a cored bar 34A made of SUS of a diameter of 11.5 mm.

Hereinafter, the layout and construction of the above-mentioned insulator coated electrode roller 34, and grounds for the determination of a voltage to be applied are described.

In the developing apparatus 24 of such a construction, at the time of a developing operation, as illustrated in FIG. 2, a toner 32 in the developing container 31, by the rotation of the insulator coated electrode roller 34 in the direction indicated by the arrow C, is carried on the insulator coated electrode roller 34 and conveyed into the proximity of the developing roller 33, that is into the developer supplying and removing region $T_S$.

The toner 32 carried on the insulator coated electrode roller 34 is conveyed (fed) to the developing roller 33 due to the presence of an oscillating electric field produced by an alternating current voltage applied from a power supply 39 in the position of the gap S between the developing roller 33 and the insulator coated electrode roller 34, that is in the developer supplying and removing region $T_S$. At this time, the toner 32 is frictionally charged by the developing roller 33, and adheres onto the developing roller 33.

Thereafter, the toner 32, accompanied by the rotation in the direction indicated by the arrow B of the developing roller, is fed under a contact pressure of the developing blade 35, and here, received with an appropriate triboelectricity (frictional charge amount) as well as being formed in a thin layer on the developing roller 33. That is, the toner on the developing roller 33 is regulated in thickness, as well as to have the appropriate charge amount with the developing blade 35. In this embodiment, the toner after having passed the developing blade 35 is set so as to obtain −100 to −20 μC/g as a favorable amount of charge, 0.25 to 1.0 mg/cm$^2$ as a favorable toner coat amount, and 7 to 20 μm as a toner layer thickness. In this embodiment, a normal charging polarity of a toner, which is a charging polarity of a toner for use in a normal development is a negative charging polarity.

A toner layer having been formed in a thin layer on the developing roller 33 is uniformly conveyed to a developing portion $T_D$, being an opposite portion to the photosensitive drum 21. At this developing portion $T_D$ a toner layer having been formed in a thin layer on the developing roller 33 is developed as a toner image on an electrostatic latent image on the photosensitive drum 21 by a developing bias applied from a power supply 40 between the developing roller 33 and the photosensitive drum 21. In this embodiment, the developing roller 33 is provided in contact with the photosensitive drum 21. As a developing bias, a direct current voltage with no alternating current voltage is used. As a result, an oscillating electric field formed between the developing roller 33 and the electrode roller 34 is formed by the power supply 39 and the power supply 40. That is, the power supply 39 and the power supply 40 are an electric field forming apparatus.

Undeveloped toner on the developing roller 33 that is not consumed at the developing portion $T_D$ is transported from the underside of the developing roller 33 into the developing container 31 accompanied by the rotation B of the developing roller 33 and collected.

This collected undeveloped toner on the developing roller 33 is removed from the surface of the developing roller 33 by the action of an oscillating voltage applied to the electrode roller 34 in a developer supplying and removing region $T_S$ where the electrode roller 34 and the developing roller 33 are opposed to each other with a gap S therebetween. This oscillating voltage is a superimposed voltage of a direct current voltage and an alternating current voltage. The direct current voltage (direct potential) to be applied to the electrode roller 34 is set to be the same as a direct current voltage (direct potential) to be applied to the developing roller 33. Alternatively, in the oscillating voltage, the direct current voltage (direct potential) to be applied to the electrode roller 34, with respect to the direct current voltage (direct potential) to be applied to the developing roller 33, is set to be on the opposite side to a normal charging polarity of the toner. That is, the direct potential of the oscillating voltage, with respect to a direct potential of a developing bias, is on the side of an opposite polarity to the normal charging polarity of the toner 32, which is on the plus side with respect to −300 V of the developing bias. Incidentally, it is a matter of course that the oscillating voltage or the superimposed voltage may be formed by repeating a changeover of an output value only from a direct current power supply without using an alternating current power supply.

Incidentally, in this embodiment, "voltage on the side of the opposite polarity to the normal charging polarity of the toner (developer) with respect to the direct potential to be applied to the developing roller" refers to a voltage at a potential of the same polarity as the charging polarity of the developer, as well as of an absolute value smaller than the direct potential applied to the developing roller (inclusive of the same potential), and a voltage at a potential of the opposite polarity to the charging polarity of the developer.

Accordingly, in this embodiment, the developing bias, that is the direct potential to be applied to the developing roller is −300 V, so that the voltage to be applied to the electrode roller is preferably set to be from −300 V to 0 V and at a voltage larger than 0 V.

Most toner having been removed from the surface of the developing roller 33 is conveyed, and then supplied to the developing roller 33 again accompanied by the rotation of the insulator coated electrode roller 34, to repeat the above-described action.

TABLE 1

| | Electrode roller construction | | | | Applied voltage arrangement | | | | Image evaluation | |
|---|---|---|---|---|---|---|---|---|---|---|
| | Electrode roller cored bar diameter (mm) | Insulating layer thickness (μm) | Gap between electrode roller and developing roller (μm) | Rotation direction | Direct current voltage (V) | Alternating current voltage Peak-to-peak voltage (Vpp) | Maximum electric field between electrode roller cored bar and developing roller (V/m) | Frequency (Hz) | Solid black follow-up property | Developing ghost |
| Experimental Example 1 | 11.5 | 100 | 150 | Same as developing roller | +2000 | 4000 | $1.7 \times 10^7$ | 400 | ○○ | ○○ |
| Experimental Example 2 | 11.5 | 100 | 150 | Same as developing roller | −300 | 0 | 0 | 0 | X | X |
| Experimental Example 3 | 11.5 | 100 | 150 | Same as developing roller | −300 | 4000 | $8.0 \times 10^6$ | 400 | Δ | Δ |
| Experimental Example 4 | 11.5 | 100 | 150 | Same as developing roller | −300 | 5000 | $1.0 \times 10^7$ | 400 | ○ | Δ |

TABLE 1-continued

| | Electrode roller construction | | | | Applied voltage arrangement | | | | Image evaluation | |
|---|---|---|---|---|---|---|---|---|---|---|
| | Electrode roller cored bar diameter (mm) | Insulating layer thickness (μm) | Gap between electrode roller and developing roller (μm) | Rotation direction | Direct current voltage (V) | Alternating current voltage Peak-to-peak voltage (Vpp) | Maximum electric field between electrode roller cored bar and developing roller (V/m) | Frequency (Hz) | Solid black follow-up property | De-veloping ghost |
| Experimental Example 5 | 11.5 | 100 | 150 | Same as developing roller | −4300 | 0 | $1.6 \times 10^7$ | 0 | X | X |
| Experimental Example 6 | 11.5 | 100 | 150 | Same as developing roller | 3700 | 0 | $1.6 \times 10^7$ | 0 | X | X |
| Experimental Example 7 | 11.5 | no | 250 | Same as developing roller | −300 | 4000 | $8.0 \times 10^6$ | 400 | X | Δ |
| Experimental Example 8 | 11.5 | 100 | 150 | Same as developing roller | −2300 | 4000 | $1.6 \times 10^7$ | 400 | X | X |
| Experimental Example 9 | 11.5 | 100 | 150 | Same as developing roller | +200 | 4000 | $1.0 \times 10^7$ | 400 | ○ | ○ |
| Experimental Example 10 | 11.5 | 100 | 150 | Same as developing roller | +1700 | 4000 | $1.6 \times 10^7$ | 400 | ○○ | ○○ |
| Experimental Example 11 | 11.2 | 100 | 300 | Same as developing roller | +2000 | 4000 | $1.1 \times 10^7$ | 400 | ○ | ○ |
| Experimental Example 12 | 11.0 | 100 | 400 | Same as developing roller | +2000 | 4000 | $8.6 \times 10^6$ | 400 | Δ | Δ |
| Experimental Example 13 | 11.5 | 100 | 150 | No rotation | +2000 | 4000 | $1.7 \times 10^7$ | 400 | X | X |
| Experimental Example 14 | 11.5 | 100 | 150 | Opposite direction to developing roller | +2000 | 4000 | $1.7 \times 10^7$ | 400 | X X | X |

In an image evaluation of Table 1, first, evaluated was a solid black follow-up property (entire printable region on a sheet of A4 portrait size is printed at the maximum density to evaluate a toner supplying capacity) when the layout and construction of the insulator coated electrode roller 34, and a voltage to be applied from the power supply 39 are changed. Furthermore, in an image evaluation, second, evaluated was a development ghost (halftone image is printed after the maximum density patch of 20 mm square having been printed, and then a toner removing capacity is evaluated based on the presence or absence of a printing history of the patch).

In an image evaluation of Table 1, oo is at a very good level image, o is at a good level image, Δ is at a tolerable level image, and x is an NG level image, and xx is an image at a level worse than x.

In Table 1, an applied voltage arrangement stands for a voltage to be applied to the electrode roller 34. Experimental example 1, being an embodiment is very good in an image evaluation.

An experimental example 2, being a comparative example and experimental examples 3 and 4, being embodiments are different in a direct current voltage with respect to the experimental example 1. That is, in the experimental examples 2, 3 and 4, a direct current voltage to be applied to an electrode roller is at the same potential (−300 V) as that of a developing bias applied to the developing roller 33, and an alternating current voltage to be applied to the insulator coated electrode roller 34 was varied. As a result, by making the maximum electric field between the cored bar 34A of the electrode roller 34 and the developing roller 33 not less than 8.0×106 V/m as are the experimental examples 3 and 4, the solid black follow-up property and the development ghost were improved. Furthermore, when the maximum electric field is made still larger as the experimental example 4, although a solid black follow-up property was further improved, the development ghost was found not to change. In the experimental example 2, the alternating current voltage to be applied to the insulator coated electrode roller 34 was zero (0), and an image evaluation was at the NG level.

The reason of improvement in an image quality by the production of an oscillating electric field between the above-mentioned insulator coated electrode roller 34 and developing roller 33 was found with the following test.

By fabricating a longitudinal end portion of the developing apparatus 24 with a transparent acryl board, the portion in the vicinity of a toner supplying portion was made visible.

As a result, by the production of the above-mentioned oscillating electric field, a toner 32A having been conveyed by the electrode roller 34 is prevented from movement D in the developer supplying and removing region $T_S$, that is a toner supplying portion F. In addition, with an oscillating electric field, a movement E of the toner 32A being carried on the developing roller 33 was observed. The reason thereof is probably that the toner 32A temporarily resided at the toner supplying portion F generates a frictional charge with the developing roller 33, and is carried onto the developing roller 33 by an image force.

Figure 3:
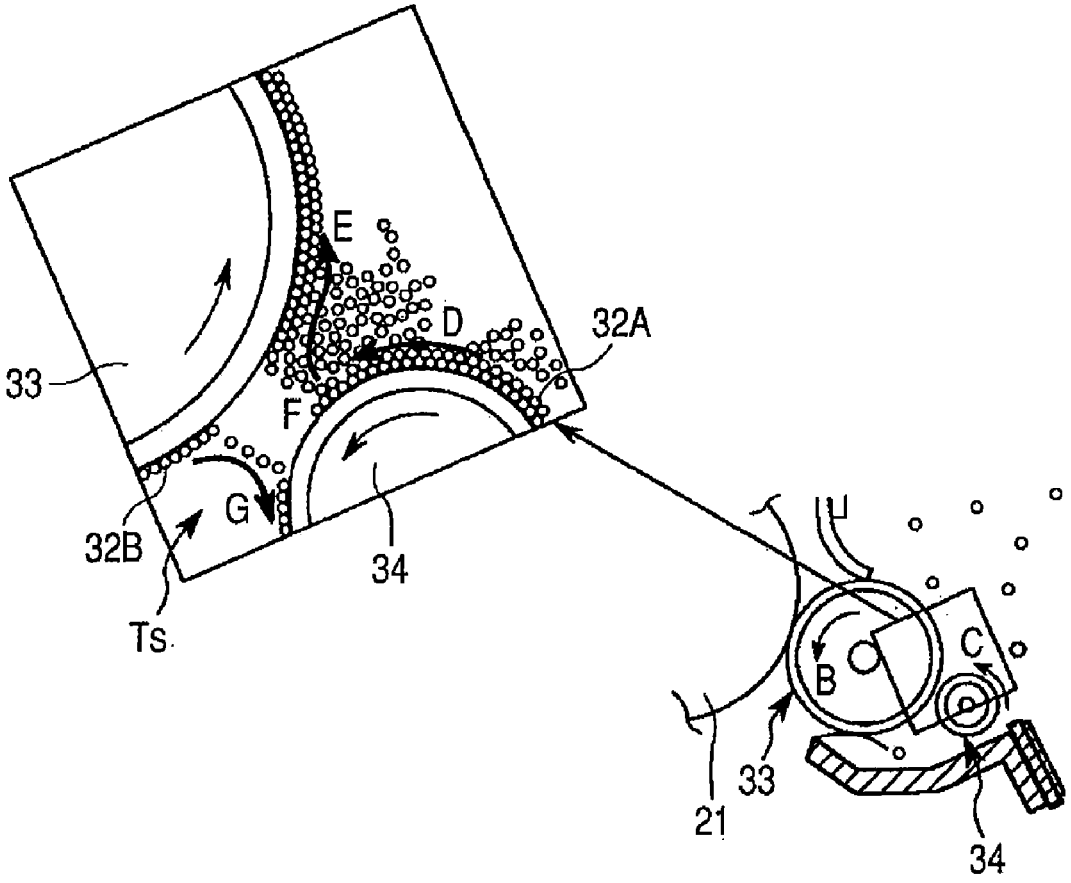
FIG. 3 is a view illustrating the movement of a developer in the developing apparatus according to the present invention.

Such a phenomenon is a phenomenon remarkably occurring by the application of an alternating current voltage to the toner supplying portion F. As are the experimental examples 5 and 6, being a comparative example in table 1, when an alternating current voltage is zero (0), and only a direct current voltage is applied, even if the maximum electric field between the insulator coated electrode roller cored bar 34A and the developing roller 33 is made to be not less than 8.0×106 V/m, no movement E of a toner as illustrated in FIG. 3 occurred, no improvement was found in the image evaluation as well. That is, the experimental examples 5 and 6 are at the NG level.

In the experimental example 7, being a comparative example in Table 1, an electrode roller 34 applied with no insulating coating 34B is used. As a result, since the electrode roller is not processed with the insulating coating, an electric current was leaked to the developing roller 33, and thus the failure of a toner coat on the developing roller 33 occurred. That is, it is at the NG level.

As described above, to obtain a more preferable maximum electric field, a voltage resistance provided by the insulating coating 34B was found to be necessary.

Thus, in conventional developing apparatuses, a low-voltage arrangement is employed in order to prevent the leakage between a developing roller and an electrode, so that the movement of a toner as illustrated in FIG. 3 is thought not to occur in conventional developing apparatuses.

Next, by the application of an alternating current voltage superimposed on a direct current voltage to the toner supplying portion F, the improvement of an image quality was attempted.

In the experimental examples 1, 3, 9 and 10, being embodiments, and the experimental example 8, being a comparative example, alternating current voltages are the same, but different direct current voltages are superimposed on the alternating current voltages, respectively. The direct current voltages were to be −2300 V, 200 V, 1700 V, and 2000 V so as to be larger in order of the experimental examples 8, 9, 10, and 1. As a result, as illustrated in the experimental example 8, when the direct current voltage to be applied to the insulator coated electrode roller 34, with respect to the direct current voltage of the developing bias, on the side of the same polarity as the normal charging polarity of the toner 32, there was no image improvement. That is, the experimental example 8 is at the NG level.

On the other hand, when as are the experimental examples 9, 10, and 1, the direct potential to be applied to the insulator coated electrode roller 34, with respect to the direct potential of the developing bias, is on the side of the opposite polarity to the normal charging polarity of the toner 32, and an image is improved in quality as compared with the experimental example 3.

The reason thereof is that in the experimental examples 1, 9, and 10, the direct potential to be applied to the insulator coated electrode roller 34, with respect to the direct potential of the developing bias, being on the side of the opposite polarity to the normal charging polarity of the toner makes the movement G of removing the toner 32B of FIG. 3 more notably than that of the experimental example 3. Accordingly, there is no occurrence of a development ghost. In addition, since a toner having been collected by the insulator coated electrode roller 34 is supplied again as a toner charged to some extent, the solid black follow-up property is improved as well.

On the other hand, in the experimental examples 11 and 12, being embodiments, with respect to the experimental example 1, although the voltage to be applied to the insulator coated electrode roller 34 is the same, with respect to the experimental example 1, the diameter of the cored bar 34A of the insulator coated electrode roller 34 is varied. Therefore, in the experimental examples 1, 11 and 12, distances between the developing roller 33 and the electrode roller 34 are different from each other. As a result, in the experimental examples 11 and 12, in spite of the fact that the applied voltage is not different from that in the experimental example 1, the image evaluations of the solid black follow-up property and the development ghost were at a good level and at a tolerable level respectively, but have not reached a very good level. From this result, what exerts an effect on the solid black follow-up property and the development ghost was found not to be a value itself of the applied voltage to the insulator coated electrode roller 34, but to be the maximum electric field between the developing roller 33 and the insulator coated electrode roller cored bar 34A.

Thus, if the direct potential of the electrode roller 34, with respect to the direct potential of the developing roller, is on the side of the opposite polarity to the normal charging polarity of the toner, and that the maximum electric field between the electrode roller and the developing roller is not less than $1.0\times10^7$ V/m, the solid black follow-up property and the development ghost are improved (the experimental examples 1, 9, 10 and 11). Furthermore, if the maximum electric field is not less than $1.6\times10^7$ V/m, the solid black follow-up property and the development ghost are optimized (the experimental examples 1 and 10).

In addition, as are the experimental examples 10 and 1, when the oscillating voltage to be applied to the electrode roller, with respect to the direct potential to be applied to the developing roller, is at a potential on the side of the opposite polarity to the normal charging polarity of the toner at all times, the image evaluation was at a very good level, and thus an optimum image could be obtained. That is, in the experimental examples 10 and 1, although the alternating current voltage is applied to the electrode roller, this alternating current voltage is set to be such a voltage that no electric field alternating between the electrode roller and the developing roller is formed.

Furthermore, when the electrode roller 34 and the developing roller 33 are in contact with each other, since the toner 32 is secured onto the developing roller 33, the insulator coated electrode roller 34 and the developing roller 33 are preferably spaced apart by not less than 10 μm.

Furthermore, experiments as to the rotation direction of the insulator coated electrode roller 34 were performed.

Experimental example 13, being a comparative example, is one in which an applied voltage arrangement is the same as that of the experimental example 1, and in which the rotation of the electrode roller 34 is stopped. As a result, there is no toner conveyance D made by the insulator coated electrode roller 34 to the toner supplying position F of FIG. 3, and thus the solid black follow-up property is poor. That is, the image evaluation is at the NG level.

Figure 4:
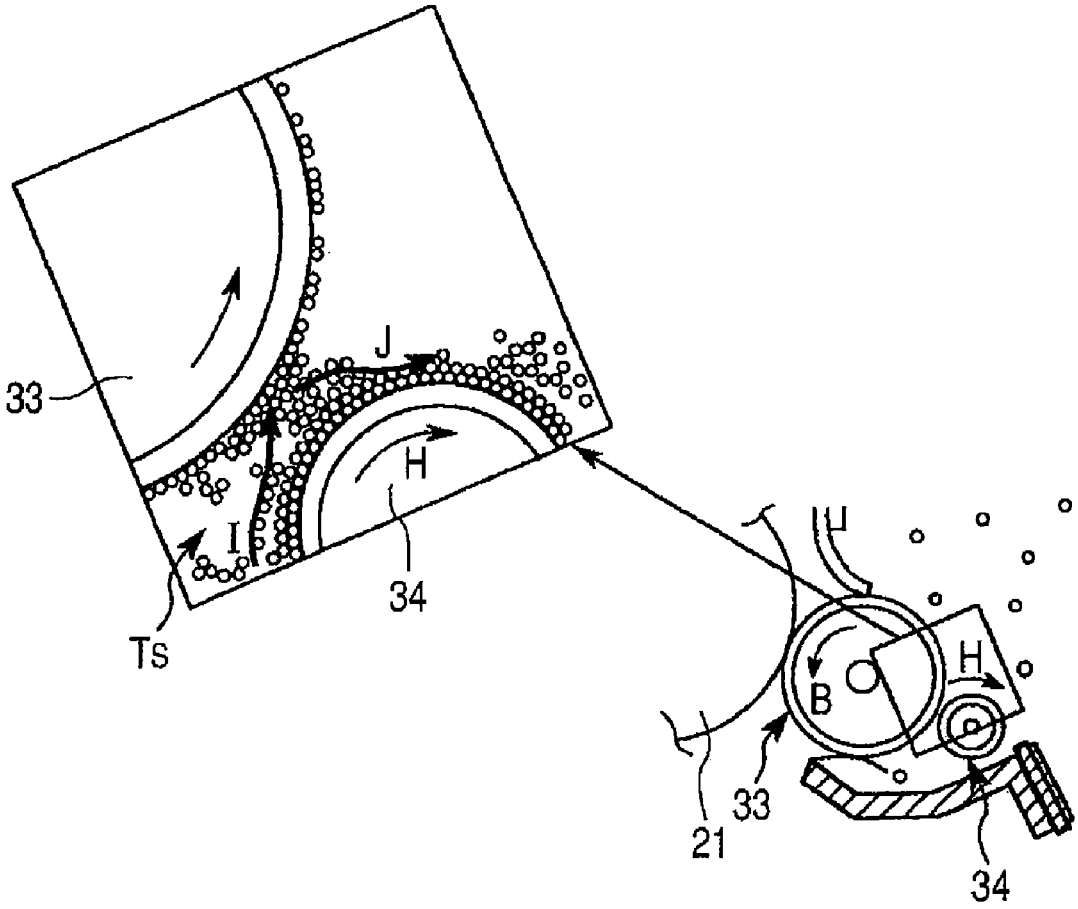
FIG. 4 is a view illustrating the movement of a developer in a developing apparatus in an experimental example.

Experimental example 14, being a comparative example, is the one in which an applied voltage arrangement is the same as that of the experimental example 1, and in which as illustrated in FIG. 4, at a portion where the electrode roller and the developing roller are opposed, the rotation of the insulator coated electrode roller 34 is in an opposite direction H to that of the developing roller 33. As a result, as illustrated in FIG. 4, with respect to the rotation of the developing roller, first a toner supply I is made, and thereafter, downstream of a toner supplying position, a toner removal J is made with an oscillating voltage on the side of the opposite polarity to that of the toner with respect to the developing bias, so that the solid black follow-up property is poor. That is, the image evaluation is at the NG level.

Now, the frequency of the alternating current voltage for use in this embodiment was studied. The frequency of the alternating current voltage was found to have the following characteristics. One is that in case of not more than 300 Hz of a frequency, an uneven toner coat corresponding to the frequency occurs on the developing roller; and another one is that in case of not less than 300 Hz of a frequency, the toner cannot follow up relative to the change of the electric field, the movement of the toner as illustrated in FIG. 3 comes to be smaller, and thus the solid black follow-up property becomes worse. This phenomenon was changed based on a circumferential speed of the developing roller, and when in the following relationship, this phenomenon was found to improve.

$$2.5<f/d<25 \qquad \text{expression 1}$$

Where: a letter d in the expression 1 stands for a circumferential speed (mm/sec) of the developing roller, and a letter f stands for a frequency (Hz) of an alternating current voltage. When f/d is not more than 2.5, the above-described uneven toner coat is likely to occur. When f/d is not less than 25, the supply of the toner onto the developing roller becomes unstable, and thus a solid black in an image is likely to be short of toner. Accordingly, in this embodiment, the frequency of the alternating current voltage is set to be 400 Hz.

From the foregoing discussion, the rotation direction of the insulator coated electrode roller 34 is the same as the direction of the developing roller 33, that is, in the developer supplying and removing region TS where the insulator coated electrode roller 34 and the developing roller 33 are opposed to each other, it was found to be optimum that the insulator coated electrode roller 34 is rotated in an opposite direction to that of the developing roller 33.

Incidentally, although a cored bar of the insulator coated electrode roller 34, in this embodiment, is made of SUS, it may be made of a resin or rubber in which a conductive agent is dispersed that is any conductive material just functioning as an electrode. Also an insulating coat material has only to have insulating properties, as well as has only to be voltage resistant with respect to a predetermined maximum electric field. Although as a material, in this embodiment, a polycarbonate resin is used, alternatively, resins such as polyester, polyethylene, polyimide, urethane and phenol, resins having a larger voltage resistance such as a fluororesin, a rubber material such as silicone rubber, or an insulating inorganic compound such as alumite may be used.

Furthermore, although in this embodiment, a roller-shaped insulator coated electrode roller 34 is used as the developer supplying and removing member 34, one in which the surface of a conductive endless belt is treated by an insulting coating may be employed. On that occasion, the maximum electric field in the vicinity of a toner supplying position needs to be only in the relationship indicated in this embodiment.

Moreover, although in this embodiment, the case in which the developing apparatus according to the present invention is applied to the developing cartridge detachably mountable to the image forming apparatus main body 20A, is described, it may be applied to a developing apparatus of such a construction as to be fixed in an image forming apparatus main body, and replenished with a toner only. Furthermore, in FIG. 1, the developing apparatus according to the present invention may be applied to a process cartridge integrally formed of the above-mentioned developing apparatus 24, and the photosensitive drum 21, the cleaning device 27 and the charger 22, and detachably mountable to the image forming apparatus main body 20A.

As described above, according to this embodiment, by disposing an electrode roller that is coated with an insulator with a gap in the proximity of a developing roller; rotating the insulator coated electrode roller and the developing roller in the same direction; and producing an oscillating electric field between the insulator coated electrode roller and the developing roller, and furthermore, since particularly when an alternating current voltage is applied to the electrode roller, a toner can be supplied or removed with respect to the developing roller using one piece of the insulator coated electrode roller irrespective of whether the toner is magnetic or non-magnetic, an advantage of downsizing of a developing apparatus, the reduction of a rotation driving torque, and a low load onto a toner can be obtained.

In addition, if a direct potential to be applied to the electrode roller and a direct potential to be applied to the developing roller are the same, and the maximum electric field between the electrode roller cored bar and the developing roller is not less than $8.0\times10^6$ V/m, an image evaluation can be at the tolerable level.

Moreover, the direct potential to be applied to the electrode roller, with respect to the direct potential to be applied to the developing roller, is set to be on the side of the opposite polarity to the normal charging polarity of the toner. Whereby, when the maximum electric field between the electrode roller cored bar and the developing roller is not less than $1.0\times10^7$ V/m, the solid black follow-up property and the development ghost are improved, and thus the image evaluation can be at the good level.

Furthermore, when the maximum electric field between the electrode roller and the developing roller is not less than $1.6\times10^7$ V/m, the solid black follow-up property and the development ghost are optimized, and thus the image evaluation can be at the very good level.

Embodiment 2

In this embodiment, the specifications of an alternating current voltage to be applied to an insulator coated electrode roller is changed with respect to the embodiment 1, and the other construction is the same as that of the embodiment 1. Furthermore, in this embodiment, a direct potential to be applied to the electrode roller, with respect to a direct potential to be applied to the developing roller (−300 V), is set to be on the opposite side to the normal charging polarity of the toner. In this embodiment (experimental examples 15, 19 and 20), to the insulator coated electrode roller 34 illustrated in FIG. 2, a bias of an alternating current voltage of a rectangular wave of 3 kVpp and a frequency of 400 Hz being superimposed on a direct current voltage of +1.5 kV is applied from the power supply 39 of the image forming apparatus. In experimental examples 16, 17 and 18, being embodiments, a direct current voltage to be applied to the electrode roller and a peak-to-peak voltage of an alternating current voltage are varied respectively. Whereby, as is the embodiment 1, in the developer supplying and removing region TS, an oscillating electric field is produced between the developing roller 33 and the insulator coated electrode roller 34, and a favorable toner coat is obtained on the developing roller.

TABLE 2

| | Electrode roller construction | | | | Applied voltage arrangement | | | | Image evaluation | |
|---|---|---|---|---|---|---|---|---|---|---|
| | Electrode roller cored bar diameter (mm) | Insulating layer thickness (μm) | Gap between electrode roller and developing roller (μm) | Rotation direction | Direct current voltage (V) | Alternating current voltage Peak-to-peak voltage (Vpp) | Maximum electric field between electrode roller cored bar and developing roller (V/m) | Frequency (Hz) | Solid black follow-up property | De-veloping ghost |
| Experimental Example 15 | 11.5 | 100 | 150 | Same as developing roller | +1500 | 3000 | $1.3 \times 10^7$ | 400 | ○○ | ○○ |
| Experimental Example 16 | 11.5 | 100 | 150 | Same as developing roller | +200 | 2000 | $6.0 \times 10^6$ | 400 | Δ | Δ |
| Experimental Example 17 | 11.5 | 100 | 150 | Same as developing roller | +200 | 3000 | $8.0 \times 10^6$ | 400 | ○ | ○ |
| Experimental Example 18 | 11.5 | 100 | 150 | Same as developing roller | +700 | 3000 | $1.0 \times 10^7$ | 400 | ○○ | ○○ |
| Experimental Example 19 | 11.2 | 100 | 300 | Same as developing roller | +1500 | 3000 | $8.3 \times 10^6$ | 400 | ○ | ○ |
| Experimental Example 20 | 11.0 | 100 | 400 | Same as developing roller | +1500 | 3000 | $6.6 \times 10^6$ | 400 | Δ | Δ |

Table 2, at the time of using an alternating current voltage of a rectangular waveform, being characteristics of this embodiment, is a summary of image evaluations of a solid black follow-up property and a development ghost when the layout and construction of an insulator coated electrode roller 34 and the voltage to be applied from the power supply 39 are varied as is table 1.

In the experimental example 15, the image evaluation is at the very good level. In the experimental examples 16, 17 and 18, with respect to the experimental example 15, when an alternating current voltage using a rectangular wave and a direct current voltage are varied, maximum electric fields between the electrode roller cored bar and the developing roller, and image evaluation ranks are summarized.

In the experimental examples 19 and 20, with respect to the experimental example 15, a direct current voltage and an alternating current voltage to be applied to the electrode roller are not changed, but a gap between the electrode roller and the developing roller is changed.

As shown in Table 2, according to the experimental examples 15 to 20, by making the above-mentioned maximum electric field not less than $6.0\times10^6$ V/m, the image evaluation can be at the tolerable level. Furthermore, according to the experimental examples 15, 17, 18 and 19, by making the above-mentioned maximum electric field not less than $8.0\times10^6$ V/m, the image evaluation can be at the good level. Moreover, according to the experimental examples 15 and 18, by making the above-mentioned maximum electric field not less than $1.0\times10^7$ V/m, the image evaluation can be at the very good level.

From these results, as compared with the embodiment 1, the maximum electric field between the electrode roller cored bar and the developing roller required to improve the image evaluation rank was found to be smaller. That is, changing the waveform of the alternating current voltage from a sine wave to a rectangular wave allows obtaining a sharper change in the electric field between the electrode roller cored bar 34A and the developing roller 33, and thus the toner can be effectively supplied and removed. As a result, the alternating current voltage and the direct current voltage to be applied to the electrode roller can be made smaller.

Incidentally, in this embodiment, the case in which the developing apparatus according to the present invention is applied to the developing cartridge detachably mountable to the image forming apparatus main body 20A, is described. However, the developing apparatus may be applied to one having such a construction as to be fixed in an image forming apparatus main body, and replenished with a toner only. Furthermore, the developing apparatus according to the present invention may be applied to a process cartridge integrally formed of the above-mentioned developing apparatus 24, and the photosensitive drum 21, the cleaning device 27 and the charger 22, and detachably mountable to the image forming apparatus main body 20A.

As described above, according to this embodiment, in addition to effects obtained in the embodiment 1, by using the rectangular wave of the alternating current voltage, the toner can be supplied and removed at the lower voltage.

Embodiment 3

Figure 5:
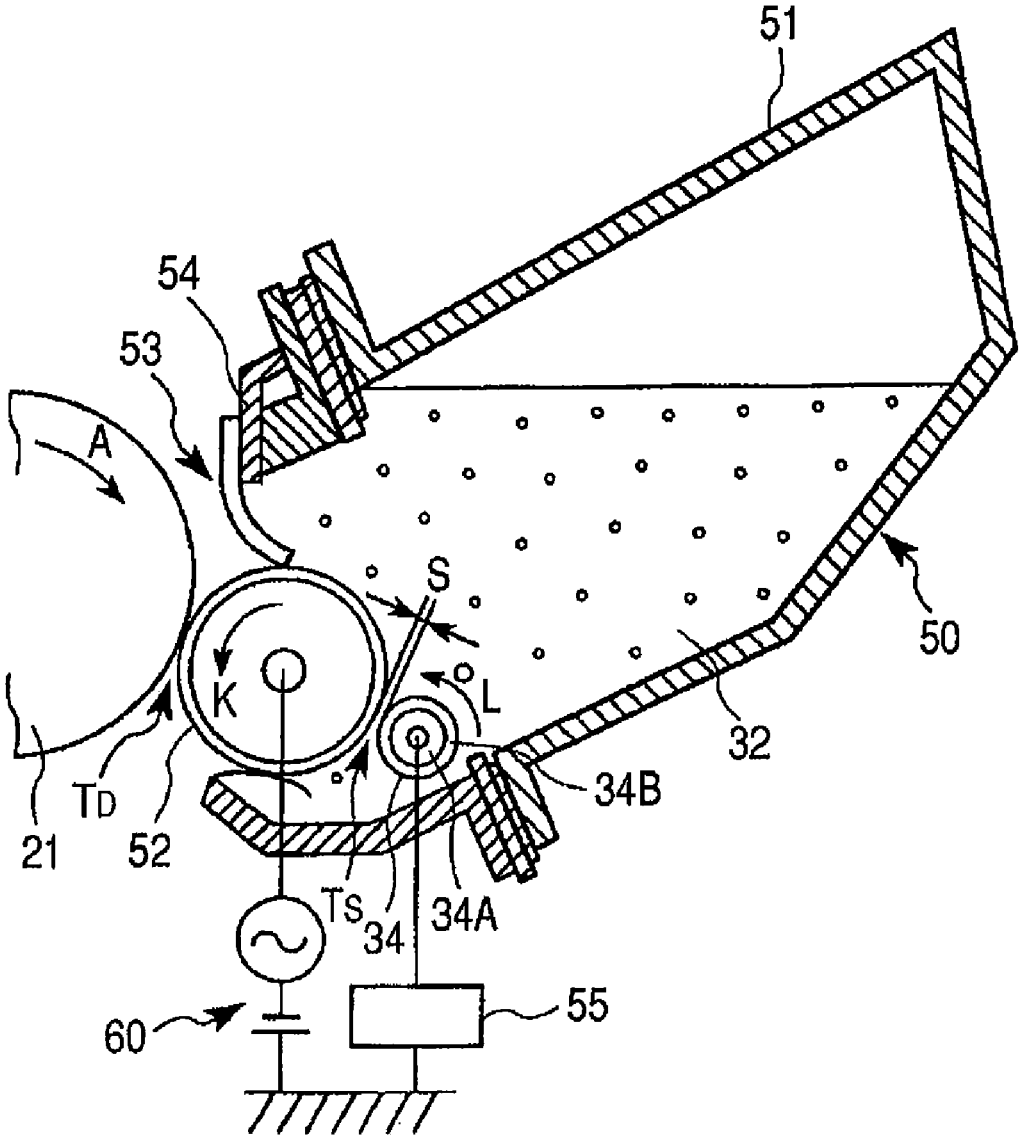
FIG. 5 is a schematic view illustrating another embodiment of a developing apparatus according to the present invention.
Figure 6:
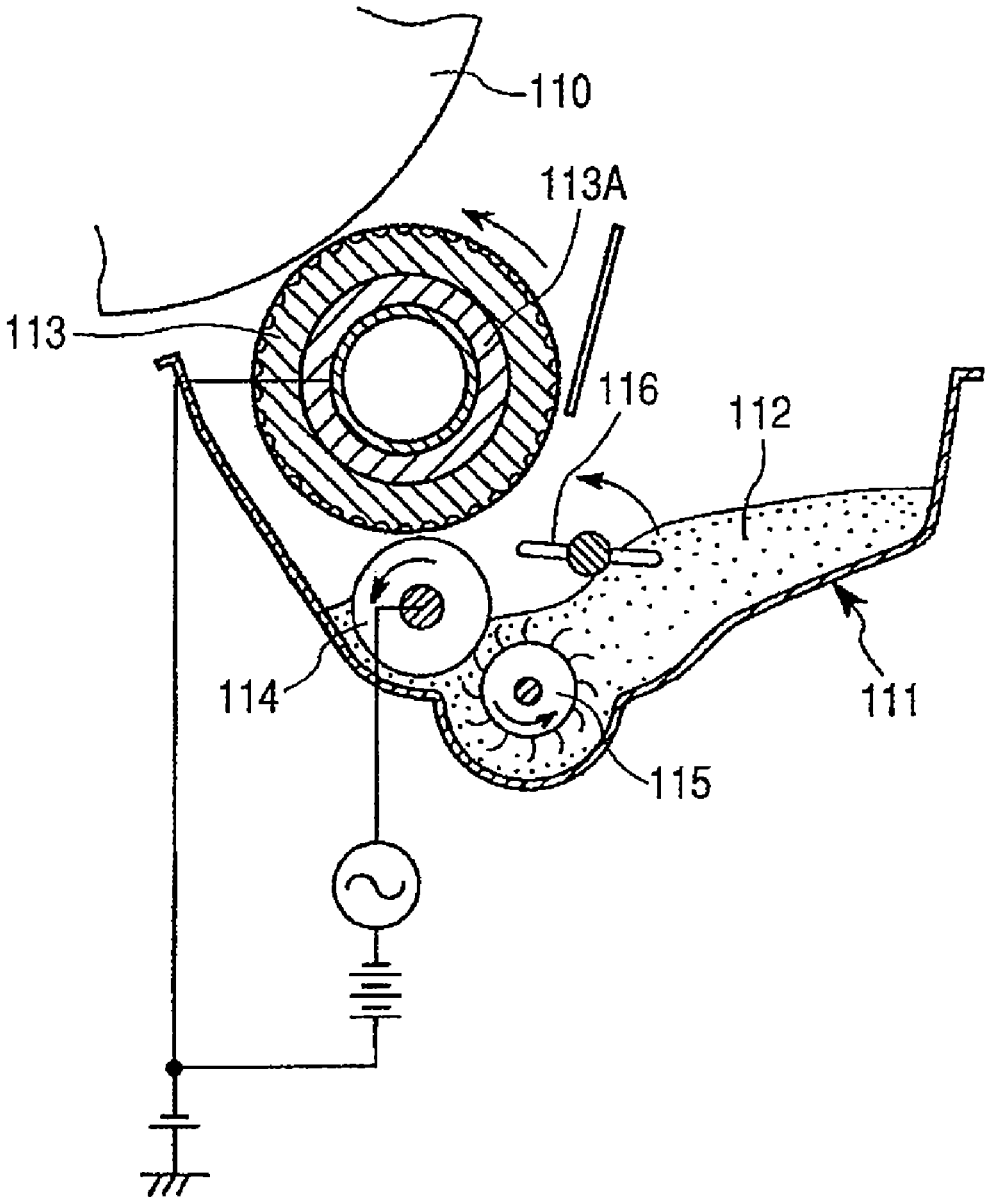
FIG. 6 is a view illustrating a conventional example.

FIG. 5 illustrates another embodiment of a developing apparatus according to the present invention. In this embodiment, a developing apparatus 50 can be applied to the image forming apparatus described in the embodiment 1, and the description of the image forming apparatus made in the embodiment 1 are incorporated in the embodiment 3. Also in the developing apparatus 50 according to this embodiment, the entire construction and function thereof are the same as those of the developing apparatus 24 of the embodiment 1 and the embodiment 2, so that like reference numerals denote members of the same construction and function, duplicated descriptions thereof are omitted, and mainly, characteristics of this embodiment will be described hereinafter.

In FIG. 5, the developing apparatus 50 according to this embodiment is provided with a developing container 51 in which a nonmagnetic toner 32 as a mono-component developer is contained, and a developing sleeve 52 as a developer carrying member positioned in an opening portion extended in a longitudinal direction in the developing container 51, and disposed opposite to the photosensitive drum 21. The developing apparatus 50 develops an electrostatic latent image to be visible on the photosensitive drum 21.

The developing sleeve 52, in the above-mentioned opening, is laterally provided so as to project a substantially right semicircle portion of the developing sleeve 52 into the developing container 51 as illustrated in FIG. 5, and to expose a substantially left semicircle portion of the developing sleeve 52 from the developing container 51. The surface exposed from this developing container 51, in a developing portion $T_D$ positioned on the left of the developing apparatus 50 in FIG. 5, is opposite to the photosensitive drum 21 with a very minute gap therebetween. That is, at the time of a development, the toner carried on the developing sleeve 52 flies to the photosensitive drum, thereby making a development operation.

The developing sleeve 52 is driven to rotate in the direction indicated by the arrow K, and the surface thereof includes concavities and convexities in order to achieve a higher probability of rubbing with the toner 32, as well as to make a favorable conveyance of the toner 32.

In this embodiment, the developing sleeve 52 employs one in which a surface of an aluminum sleeve of a diameter of 16 mm is subjected to blasting with use of glass beads (#600), to have a surface roughness Rz of approximately 3 μm. The developing sleeve 52 is opposed to the photosensitive drum 21 so as to have a gap of 300 μm therebetween, and rotated at a rather higher circumferential speed of 80 mm/s relative to a circumferential speed of 50 mm/s of the photosensitive drum 21.

In a position above the developing sleeve 52, to regulate the thickness of a toner layer carried on the sleeve 52, an elastic blade 53 is contacted. The elastic blade 53 is made of a rubber material such as urethane or silicone, one in which with a sheet metal of SUS or a phosphor bronze having a spring elasticity used as a base, a rubber material is adhered to the contact surface side of the developing sleeve 52, or the like. The elastic blade 53 is supported at a blade support metal plate 54, and provided so that a portion in the proximity of a tip on the free end side is in surface contact with an outer circumferential surface of the developing sleeve 52. A contact direction of the elastic blade 53 with respect to the developing sleeve 52 is the so-called counter direction in which a tip end side is positioned on the upstream side in a rotation direction of the developing sleeve 52 with respect to a contact portion.

The elastic blade 53 according to this embodiment is in such a construction that a plate-shaped urethane rubber of a thickness of 1.0 mm is adhered to a blade support metal plate 54.

The toner 32 is a nonmagnetic mono-component developer, to be the same toner as that in the embodiment 1 as described above.

In this embodiment, a developing bias to be applied to the developing sleeve 52 is one of an alternating current voltage of a rectangular waveform of Vpp 2.2 kV and a frequency of 1.8 kHz being superimposed on a direct current voltage of −300 V.

In this developing portion $T_D$, a toner layer formed in a thin layer on the developing sleeve 52, as illustrated in FIG. 5, with the alternating current voltage superimposed with the direct current voltage between the developing sleeve 52 and the photosensitive drum 21 from a power supply 60, is developed as a toner image onto an electrostatic latent image on the photosensitive drum 21.

Below the developing sleeve 52, an insulator coated electrode roller 34 is disposed such that a gap S between the insulator coated electrode roller 34 and the developing sleeve 52 is 150 μm. The insulator coated electrode roller 34 is rotatably supported, and driven to rotate at a circumferential speed of 60 mm/sec in the same direction L as that of the developing sleeve 52.

To the insulator coated electrode roller 34, a direct current voltage as shown in Table 3 is applied from a power supply 55 of an image forming apparatus. The insulator coated electrode roller 34 is so constructed that a urethane resin (insulating member) 34B of a thickness of 100 μm is put on the surface of a SUS cored bar (conductive member) 34A of a diameter of 11.5 mm.

Incidentally, also in this embodiment, the same method of supplying toner onto the developing sleeve 52 and the same method of removing toner from the developing sleeve 52 as those methods used in the embodiment 1 and the embodiment 2 are employed, and the descriptions of the duplicated points are omitted. In this embodiment, an applied voltage arrangement with respect to the insulator coated electrode roller 34 different from those of the embodiment 1 and the embodiment 2 is described.

TABLE 3

| | Electrode roller construction | | | | Applied voltage arrangement | | | | Image evaluation | |
|---|---|---|---|---|---|---|---|---|---|---|
| | Electrode roller cored bar diameter (mm) | Insulating layer thickness (μm) | Gap between electrode roller and developing roller (μm) | Rotation direction | Direct current voltage (V) | Alternating current voltage Peak-to-peak voltage (Vpp) | Maximum electric field between electrode roller cored bar and developing roller (V/m) | Frequency (Hz) | Solid black follow-up property | De-veloping ghost |
| Experimental Example 21 | 11.5 | 100 | 150 | Same as developing roller | +1600 | 0 | 1.2 × 10 | 0 | ○○ | ○○ |
| Experimental Example 22 | 11.5 | 100 | 150 | Same as developing roller | +100 | 0 | 6.0 × 10 | 0 | Δ | Δ |

TABLE 3-continued

| | Electrode roller construction | | | | Applied voltage arrangement | | | | Image evaluation | |
|---|---|---|---|---|---|---|---|---|---|---|
| | Electrode roller cored bar diameter (mm) | Insulating layer thickness (μm) | Gap between electrode roller and developing roller (μm) | Rotation direction | Direct current voltage (V) | Alternating current voltage Peak-to-peak voltage (Vpp) | Maximum electric field between electrode roller cored bar and developing roller (V/m) | Frequency (Hz) | Solid black follow-up property | De-veloping ghost |
| Experimental Example 23 | 11.5 | 100 | 150 | Same as developing roller | +600 | 0 | 8.0 × 10 | 0 | ○ | ○ |
| Experimental Example 24 | 11.5 | 100 | 150 | Same as developing roller | +1100 | 0 | 1.0 × 10 | 0 | ○○ | ○○ |

Table 3 is a summary of image evaluations on a solid black follow-up property and a development ghost when the layout and construction of the insulator coated electrode roller 34 and the voltage to be applied are varied.

In the experimental examples 21, 22, 23 and 24, being an embodiment, a direct potential to be applied to an electrode roller, with respect to a direct potential to be applied to a developing sleeve, is set to be on the side of an opposite polarity to a normal charging polarity of a toner. In the experimental examples 21, 22, 23 and 24, direct potentials to be applied to the electrode roller are different from one another. Incidentally, no alternating current voltage is applied to the electrode roller. However, an alternating current voltage is applied to the developing sleeve, so that an oscillating electric field is produced between the developing sleeve and the electrode roller. Therefore, in the experimental examples 21 to 24, maximum electric fields between a cored bar of the electrode roller and the developing roller are different from one another.

As described above, in this embodiment, since a developing method using an alternating current voltage is employed, a suitable alternating current voltage has already been obtained between the developing sleeve 52 and the insulator coated electrode roller 34. Accordingly, even if there is no application of an alternating current voltage to the electrode roller 34, only by application of direct current voltage, the result of improvement in an image quality can be obtained. Here, a direct potential to be applied to the electrode roller 34, with respect to a direct potential to be applied to the developing sleeve 52, is on the side of an opposite polarity to a normal charging polarity of a toner.

In this embodiment, owing to the fact that a direct potential to be applied to the developing sleeve 52 is −300 V, a direct potential to be applied to the electrode roller 34 is from −300 V to 0 V, and further not less than 0 V. Direct potentials to be applied to the electrode roller 34, in these experimental examples 22, 23, 24 and 21, are plus 100, 600, 1100, and 1600 V respectively.

Furthermore, different from this embodiment, when an oscillating electric field for use in a developing method is small, an alternating current voltage is applied to the insulator coated electrode roller, and thus such an electric field between the developing sleeve 52 and the insulator coated electrode roller 34 may be arranged so as to satisfy the above-mentioned maximum electric field.

In the experimental example 21, an image evaluation is at the very good level.

As a result, by causing the maximum electric field between the insulator coated electrode roller 34 and the developing sleeve 52 to be not less than $1.0\times10^7$ V/m, a solid black follow-up property and a development ghost were found to be optimum.

To summarize results of Table 3, according to the experimental examples 21 to 24, by making the above-mentioned maximum electric field not less than $6.0\times10^6$ V/m, an image evaluation can be at the tolerable level. Furthermore, according to the experimental examples 21, 23 and 24, by making the above-mentioned maximum electric field not less than $8.0\times10^6$ V/m, an image evaluation can be at the good level. Moreover, according to the experimental examples 21 and 24, by making the above-mentioned maximum electric field not less than $1.0\times10^7$ V/m, an image evaluation can be at the very good level.

Incidentally, in the embodiment 3 (Table 3), respective threshold values of the maximum electric field at the tolerable level, the good level, and the very good level of the image evaluation are the same as those of the embodiment 2 (Table 2). That is, even if an alternating current voltage is applied to the developing roller, or even if an alternating current voltage is applied to the electrode roller, in case of the same maximum electric field between the developing roller and the electrode roller, the same effect of action can be obtained in the image evaluation.

Incidentally, also in this embodiment, as are the embodiment 1 and the embodiment 2, the case in which a developing apparatus according to the present invention is applied to the cartridge comprising the developing apparatus detachably mountable to the image forming apparatus main body 20A, is described. However, the developing apparatus according to the present invention may be applied to a developing apparatus of such a construction as to be fixed in an image forming apparatus main body, and replenished with a toner only. Furthermore, the developing apparatus according to the present invention may be applied to a process cartridge integrally formed of the above-mentioned developing apparatus 50, and the photosensitive drum 21, the cleaning device 27 and the charger 22, and detachably mountable to the image forming apparatus main body 20A.

From the above-discussion, in this embodiment, in addition to effects obtained in the embodiment 1, since an alternating current voltage is used in a developing bias, an alternating current voltage needs not to be newly applied to the insulator coated electrode roller; and due to a non-contact developing method, the load onto a toner is further reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-150734, filed May 30, 2006, which is hereby incorporated by reference herein in its entirety.

What is claimed is:

1. A developing apparatus comprising:

a developer carrying member carrying a developer, and developing an electrostatic image formed on an image bearing member with the developer;

a developer supplying and removing member provided apart from the developer carrying member for supplying the developer to the developer carrying member, and for removing the developer from the developer carrying member, wherein the developer supplying and removing member includes a conductive member and an insulating member provided on the surface of the developer supplying and removing member, and in a position of supplying the developer from the developer supplying and removing member to the developer carrying member, a moving direction of the developer carrying member is opposite to a moving direction of the developer supplying and removing member; and an electric field producing device producing an electric field between the developer carrying member and the developer supplying and removing member, the electric field being an oscillating electric field, in which a direct potential of the conductive member is the same as a direct potential of the developer carrying member, or the direct potential of the conductive member, with respect to the direct potential of the developer carrying member, is on an opposite side to a normal charging polarity of the developer.

2. A developing apparatus according to claim 1, wherein a voltage to be applied to the developer carrying member is a direct current voltage without an alternating current voltage.

3. A developing apparatus according to claim 2, wherein the direct potential of the conductive member is the same as the direct potential of the developer carrying member, a voltage to be applied to the conductive member is provided with an alternating current voltage of a sine waveform, and a maximum electric field formed between the developer carrying member and the conductive member is not less than $8.0\times10^6$ V/m.

4. A developing apparatus according to claim 2, wherein the direct potential of the conductive member, with respect to the direct potential of the developer carrying member, is on the opposite side to the normal charging polarity of the developer, a voltage to be applied to the conductive member is provided with an alternating current voltage of a sine waveform, and a maximum electric field formed between the developer carrying member and the conductive member is not less than $1.0\times10^7$ V/m.

5. A developing apparatus according to claim 4, wherein the maximum electric field is not less than $1.6\times10^7$ V/m.

6. A developing apparatus according to claim 2, wherein the direct potential of the conductive member, with respect to the direct potential of the developer carrying member, is on the opposite side to the normal charging polarity of the developer, a voltage to be applied to the conductive member is provided with an alternating current voltage of a rectangular waveform, and a maximum electric field formed between the developer carrying member and the conductive member is not less than $6.0\times10^6$ V/m.

7. A developing apparatus according to claim 6, wherein the maximum electric field is not less than $8.0\times10^6$ V/m.

8. A developing apparatus according to claim 6, wherein the maximum electric field is not less than $1.0\times10^7$ V/m.

9. A developing apparatus according to claim 1, wherein a voltage to be applied to the developer carrying member is a superimposed voltage of an alternating current voltage and a direct current voltage.

10. A developing apparatus according to claim 9, wherein the direct potential of the conductive member, with respect to the direct potential of the developer carrying member, is on the opposite side to the normal charging polarity of the developer, the alternating current voltage is of a rectangular waveform, and a maximum electric field formed between the developer carrying member and the conductive member is not less than $1.0\times10^7$ V/m.

11. A developing apparatus according to claim 1, wherein the following expression is satisfied:

$$2.5<f/d<25,$$

where a circumferential speed of the developer carrying member is d (mm/sec), and a frequency of the oscillating electric field is f (Hz).

* * * * *